US006295914B1

(12) United States Patent
Iversen

(10) Patent No.: US 6,295,914 B1
(45) Date of Patent: Oct. 2, 2001

(54) PRESSURE INTENSIFIER FOR FLUIDS, PARTICULARLY FOR HYDRAULIC LIQUIDS

(75) Inventor: Jesper Will Iversen, Sønderborg (DK)

(73) Assignee: Iversen Hydraulics ApS, Sonderborg (DK)

( * ) Notice: Subject to any disclaimer, the term of this patent is extended or adjusted under 35 U.S.C. 154(b) by 0 days.

(21) Appl. No.: 08/906,844

(22) Filed: Aug. 6, 1997

(30) Foreign Application Priority Data

Aug. 17, 1996 (DE) ..... 196 33 258

(51) Int. Cl.[7] ..... F01L 25/04
(52) U.S. Cl. ..... 91/300; 417/403
(58) Field of Search ..... 91/281, 300, 319, 91/320, 290, 235, 321; 137/625.66; 417/403

(56) References Cited

U.S. PATENT DOCUMENTS

| | | | | |
|---|---|---|---|---|
| 3,367,369 | * | 2/1968 | Wagner | 137/625.66 |
| 3,477,344 | * | 11/1969 | Fisher | 137/625.66 |
| 3,713,367 | * | 1/1973 | Butterworth | 91/300 |
| 4,020,746 | * | 5/1977 | Arndt | 91/300 |
| 5,170,691 | * | 12/1992 | Baatrup | 91/287 |
| 5,890,548 | * | 4/1999 | Juvonen | 91/321 |

FOREIGN PATENT DOCUMENTS

| | | |
|---|---|---|
| 2155790 | 4/1996 | (CA) . |
| 4026005 | 2/1991 | (DE) . |
| 703369 | 3/1996 | (EP) . |
| 5330643 | 8/1978 | (JP) . |
| 5330646 | 8/1978 | (JP) . |
| 56144801 | 5/1985 | (JP) . |
| 6062602 | 5/1985 | (JP) . |

OTHER PUBLICATIONS

Ölhydraulik und Pneumatik, 37 (1993), No. 5, pp. 418, 420.
Technologie de L'Hydraulique, J.–P. De Groote, pp. 148–149.
Hydraulic Handbook, 7th Edition, p. 170.

* cited by examiner

*Primary Examiner*—F. Daniel Lopez
(74) *Attorney, Agent, or Firm*—Friedrich Kueffner

(57) ABSTRACT

A pressure intensifier for fluids, particularly for hydraulic liquids, includes a piston/cylinder arrangement with a low pressure side provided with a low pressure connection and a high pressure side provided with a low pressure connection and a supply connection, as well as an intensifier piston constructed as a double diameter piston arranged between the low pressure side and the high pressure side. The pressure intensifier further includes a valve slide member which alternatingly connects the low pressure connection to a pressure source and a negative pressure source, wherein the control valve is connected through a control line to the piston/cylinder arrangement, so that the pressure in the control line acts on a first side of the valve slide member. The control valve is configured such that a constant force acts on a second side of the valve slide member.

5 Claims, 2 Drawing Sheets

PRESSURE INTENSIFIER FOR FLUIDS, PARTICULARLY FOR HYDRAULIC LIQUIDS

BACKGROUND OF THE INVENTION

1. Field of the Invention

The present invention relates to a pressure intensifier for fluids, particularly for hydraulic liquids. The pressure intensifier includes a piston/cylinder arrangement with a low pressure side provided with a low pressure connection and a high pressure side provided with a low pressure connection and a supply connection, as well as an intensifier piston constructed as a double diameter piston arranged between the low pressure side and the high pressure side. The pressure intensifier further includes a valve slide member which alternatingly connects the low pressure connection to a pressure source and a negative pressure source, wherein the control valve is connected through a control line to the piston/cylinder arrangement, so that the pressure in the control line acts on one side of the valve slide member.

2. Description of the Related Art

Pressure intensifiers of the above-described type have the purpose of increasing the pressure in a fluid above the pressure of a pressure source. The following explanation will be with respect to hydraulic liquids. However, the principle is basically also applicable to other fluids.

A pressure intensifier of the above-described type is known from German application 40 26 005 A1. As is the case in the present invention, the known pressure intensifier is provided with a double diameter piston which acts as an intensifier piston. The intensifier includes a low pressure piston which is arranged in a low pressure cylinder and a high pressure piston which is arranged in a high pressure cylinder. Both pistons are rigidly connected to each other through a piston rod. The low pressure piston has a substantially greater cross-section than the high pressure piston. The pressure intensification between the low pressure side and the high pressure side then takes place in accordance with the ratio of the piston cross-sections. In this case as well as in the following description, the terms "low pressure" and "high pressure" are only used for distinguishing the two sides. The terms do not reflect absolute pressure values, but only relative relationships.

Hydraulic liquid is frequently removed from the high pressure side, wherein the hydraulic liquid must be replenished with the appropriate pressure. For this purpose, the high pressure cylinder, i.e., the pressure space acted upon by the high pressure piston, is filled with hydraulic liquid which is supplied from the pressure source. This causes the high pressure piston, and with it the low pressure piston, to be pushed back. The low pressure piston then displaces the hydraulic liquid out of the pressure space to the tank. Once the high pressure piston has been pushed back by a certain distance, the high pressure piston releases the opening of the control line, so that the pressure of the pressure source can act on the slide member of the control valve. The control valve is constructed as a three-way valve. When the appropriate pressure has been applied, the connection between the low pressure cylinder and the tank is interrupted and a connection between the pressure source and the low pressure cylinder is effected instead. The low pressure piston, and with it the high pressure piston, are then pushed back in the direction toward the high pressure side, so that the hydraulic liquid can be discharged through the high pressure connection at the appropriately high pressure.

In the known arrangement, the valve slide member is acted upon on one side by the pressure of the control line and on the other side by the force of a spring.

When more hydraulic liquid is to be taken out at the high pressure connection, the frequency increases at which the intensifier piston, on the one hand, and the valve slide member, on the other hand, must be moved back and forth. An increase in size of the piston/cylinder unit is possible only to a limited extent. On the one hand, this would mean that the time required for filling the high pressure side is longer. On the other hand, the mass increases, so that a fast reciprocating movement of the intensifier piston becomes more difficult. This means that the quantity that can be discharged is limited. In an embodiment of the pressure intensifier known from German patent application 40 26 005 A1, the maximum discharged quantity on the high pressure side was about 2.5 l/min, which corresponds to a maximum supplied quantity of about 10 l/min and which required a frequency of 30 Hz.

SUMMARY OF THE INVENTION

Therefore, it is the primary object of the present invention to provide a pressure intensifier of the above-described type in which the limitations described above are overcome.

In accordance with the present invention, in a pressure intensifier of the above-described type, a constant force acts on the other side of the valve slide member.

As a result of the configuration according to the present invention, the tendency of the valve slide member to reciprocate is reduced. The danger is reduced that a resonance occurs which makes a further increase of the reciprocation frequency more difficult. This makes it possible, for example, to increase the discharged quantity of hydraulic liquid at the high pressure side. Surprisingly, the structural configuration of the pressure intensifier can also be simplified. Even though the output is improved, the pressure intensifier can be manufactured less expensively.

This particularly is the case if the valve slide member is constructed as a double diameter piston which on its other side is acted upon with constant pressure. Accordingly, the double diameter piston is acted upon on one side by the pressure from the control line and on the other side with a constant pressure. The constant pressure acts on a slightly smaller surface than the pressure from the control line. Since the pressure from the control line is not present from time to time depending on the position of the intensifier piston, the valve slide member is alternatingly acted upon by a force difference in one direction and by a force difference in the opposite direction. These force differences are independent of the travel distance, i.e., they act practically over the entire travel distance of the valve slide member. The production of a force by means of a pressure can be easily realized by having the fluid act with the appropriate pressure on the end face of the valve slide member. Since the force difference is kept constant practically over the entire travel distance, relatively high accelerations can be achieved. This makes it possible to reduce the travel times. It is possible to select higher frequencies at which the pressure intensifier operates. Consequently, it is also possible to increase the discharged quantity of the high pressure fluid.

In accordance with a preferred feature, the other side of the valve slide member is acted upon by the pressure of the pressure source. This pressure is available anyhow. It is constant to a sufficient extent. Additional measures are not required.

The control line is advantageously connected to the high pressure side of the piston/cylinder arrangement in the travel range of the intensifier piston, wherein the intensifier piston closes the control line at the beginning of its movement toward the high pressure connection. This causes the pressure in the control line to be limited essentially to the pressure of the pressure source. By appropriately dimensioning the two end faces of the valve slide member, it is then possible to adjust to the desired values the force difference across the valve slide member which is necessary for moving the slide member. Accordingly, it is possible to achieve the desired pattern of movement.

The valve slide member is advantageously arranged in a valve housing so as to form an annular space to which a tank line and a pump line as well as a cylinder line between the tank line and the pump line are connected, wherein the valve slide member includes a control disk which divides the annular space and which, depending on the position of the valve slide member, is located either between the ends of the pump line and the cylinder line or of the cylinder line and the tank line. Accordingly, the control disk divides the annular space axially, i.e., in the direction of movement of the valve slide member. The control disk can be relatively thin. It is only necessary that the control disk produces a sufficient sealing effect between the two axial portions of the annular space, so that either a connection from the cylinder line to the tank is effected or a connection from the cylinder line to the pump line is effected, wherein the tank line or pump line not connected to the cylinder line should no longer have any influence on the fluid flow into or out of the cylinder line. The cylinder line is connected to the low pressure side of the intensifier piston. The tank line is connected to the negative pressure. The pump line is connected to the pressure source. By providing an annular space between the valve slide member and the valve housing, a relatively large flow cross-section is available, so that filling or emptying of the low pressure cylinder through the low pressure connection can be carried out without large throttling resistances. This also makes it possible to achieve a further speed increase.

In accordance with a particularly preferred feature, the control disk completely releases the cylinder line in that position in which a connection exists between the cylinder line and the tank line. This is the switching position of the control valve in which the fluid must be conveyed from the lower pressure side of the intensifier piston to the negative pressure source. This conveyance takes place under the pressure of the pressure source which acts on the high pressure side of the intensifier piston. On that side, an appropriately smaller cross-sectional surface of the piston is provided, so that emptying of the low pressure cylinder, which is necessary for returning the intensifier piston into its initial position, should not be impaired. When the flow cross-section for the discharged fluid can be made as large as possible or free of throttling points, this discharge of the fluid can take place without problems.

In accordance with another preferred feature, a stop means for the movement of the valve slide member is provided which keeps open the connection of its end face to the connection of the pressure source. For structural reasons, it is in some cases not possible to place a connection of the pressure source to the end face of the valve slide member in such a way that the opening of this connection and the end face are actually located opposite each other. Rather, the connection can also be arranged laterally, i.e., radially in the appropriate pressure space. If it is ensured in this case that the opening always remains accessible, the pressure which acts on the end face of the valve slide member is never throttled.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
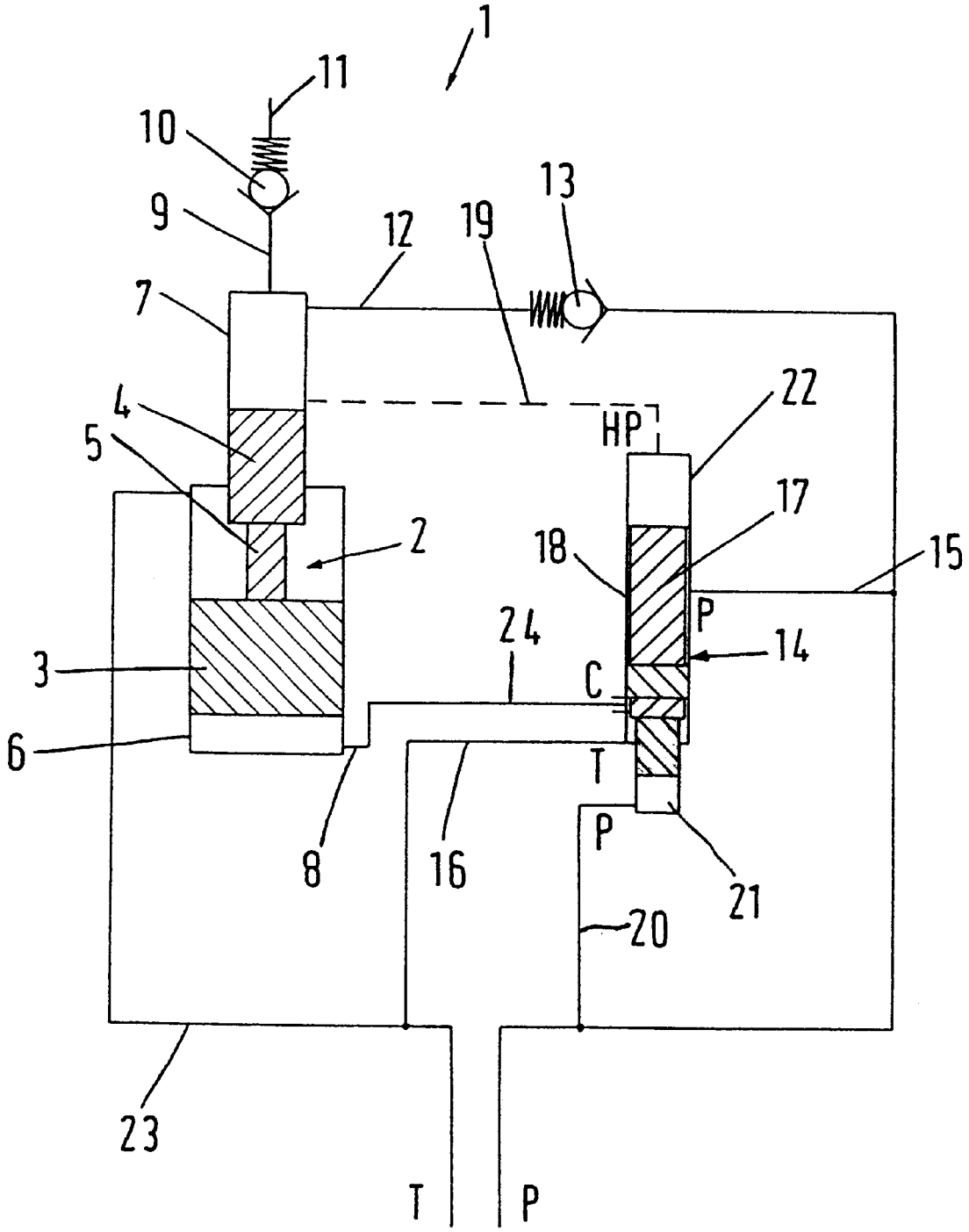
FIG. 1 is a schematic illustration of a pressure intensifier.

A pressure intensifier 1 schematically illustrated in FIG. 1 includes an intensifier piston 2 constructed as a double diameter piston. The intensifier piston 2 is formed by a low pressure piston 3 and a high pressure piston 4 which are connected to each other through a piston rod 5. The low pressure piston 3 is arranged in a low pressure cylinder 6 and forms the low pressure side therewith. The high pressure piston 4 is arranged in a high pressure cylinder 7 and forms the high pressure side therewith. The cross-section of the high pressure cylinder 7, i.e., the effective surface on which a pressure can act on the high pressure piston 4, is smaller than the cross-sectional surface of the low pressure cylinder 6. The low pressure cylinder 6 is provided with a low pressure connection 8. The high pressure cylinder 7 is provided with a high pressure connection line.

When fluid is supplied at a predetermined pressure to the low pressure cylinder 6 through the low pressure connection 8, the low pressure piston 3 moves upwardly under the pressure of this fluid. This applies a pressure to the high pressure cylinder 7 which is higher than the pressure in the low pressure cylinder 6 by the ratio between the cross-sectional surface of the low pressure piston 3 to that of the high pressure piston 4.

The high pressure connection 9 is connected through a check valve 10 to the high pressure outlet 11.

The high pressure cylinder 7 additionally includes a supply connection 12 which is connected through a check valve 13 to a pressure source P. The pressure source P may be formed, for example, by a pump.

A control valve 14 is provided for controlling the movement of the intensifier piston 2. The control valve 14 is constructed as a three-way valve which connects the low pressure connection 8 through a cylinder line 24 either to the pressure source P or to a low pressure source T, for example, a tank. For this purpose, the control valve is on one side connected to a pump line 15 which may be constructed as a connecting line to the line between the pressure source P and the check valve 13. The control valve further includes a tank line 16 which leads to the negative pressure source T. Finally, the cylinder line 24 is connected to the control valve.

The control valve 14 includes a valve slide member 17 which is axially slidably mounted in a valve housing 18. The valve slide member 17 is also constructed as a double diameter piston.

The construction of the control valve 14 will now be explained in more detail with the aid of FIGS. 2*a*–2*d*. However, it should be mentioned first that an end face of the valve slide member 17 can be acted upon by the pressure from a control line 19. The control line 19 is connected to the high pressure cylinder 7 at a location which is covered by the high pressure piston 4 soon after the high pressure piston 4 has been moved from its one end position in the direction toward the high pressure connection 9. The other end face of the valve slide member 17 is acted upon by the pressure of the pressure source P. For this purpose, another connecting line 20 is provided which is connected to a pressure space 21 in the valve housing 18. The pressure space 21 has a smaller cross-section than the bore 22 in which that end of the valve slide member 17 moves which is located adjacent the control line 19 and to which the control line 19 is connected.

Finally, a line 23 may be provided which connects the space between the low pressure piston 3 and the high pressure piston 4 to the negative pressure source T.

For making the explanation easier, the pressures acting in the control valve are identified by capital letters in FIG. 1. Thus, P corresponds to the pressure of the pressure source P, T corresponds to the pressure of the negative pressure source T, HP corresponds to the pressure in the control line 19 and C corresponds to the pressure in the cylinder line 24 which is connected to the low pressure connection 8.

FIG. 2 of the drawing shows the internal construction of the control valve 14 and additional details.

Figure 2D:
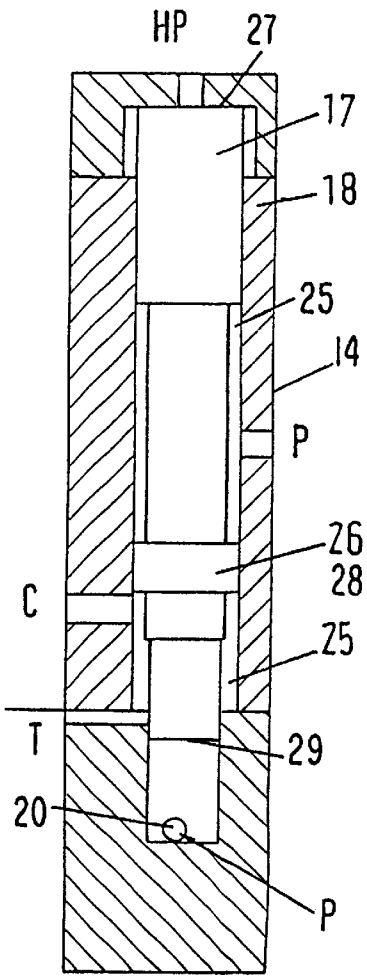
FIGS. 2*a*–2*d* are sectional views showing various positions of the valve slide member in the control valve.
Figure 2C:
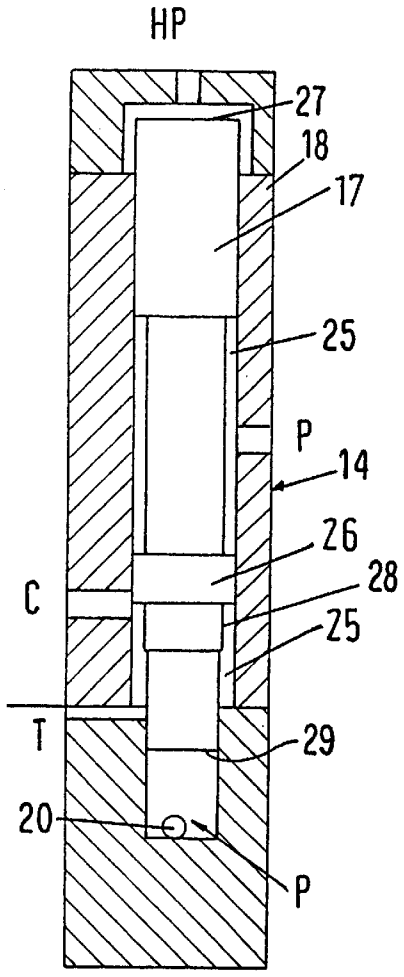
Figure 2B:
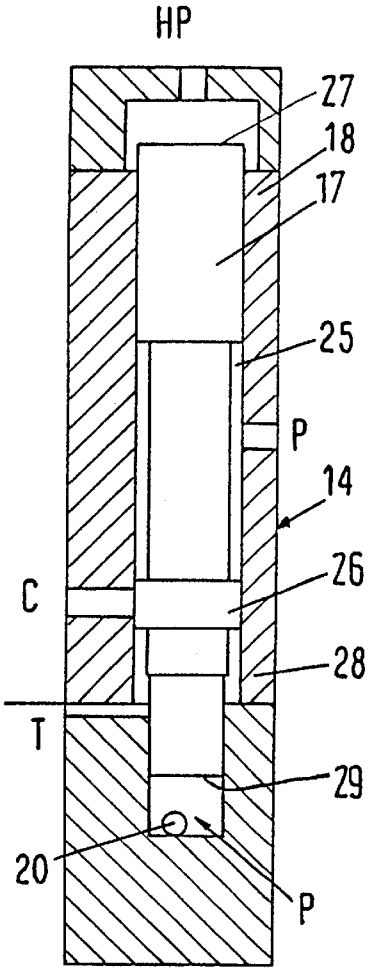
Figure 2A:
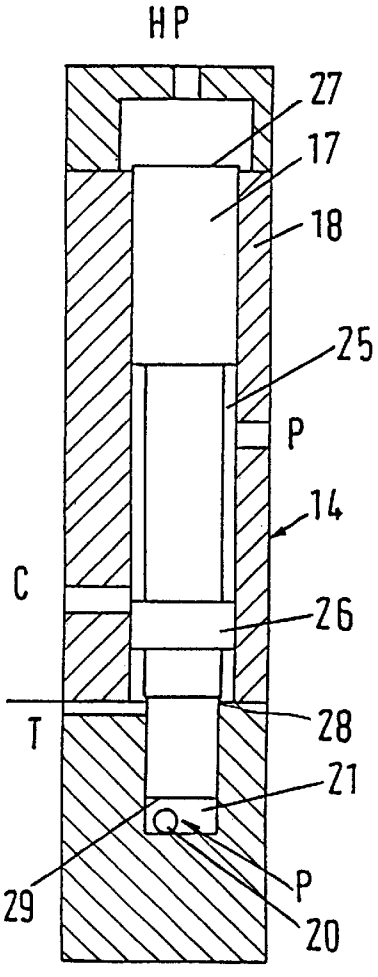

The valve slide member 17 is mounted in the valve housing 18 so as to be axially slidable. Over a portion of the length of the valve slide member 17, an annular space 25 is formed between the valve slide member 17 and the valve housing 18. A control disk 26, which sealingly rests against the valve housing 18, divides the annular space into two axial portions which are sealed from each other. Accordingly, depending on the position of the valve slide member 17, a portion of the annular space can connect the end of the pump line 15 (P) to the cylinder line 24 (C), as shown in FIG. 2*a*, or the cylinder line 24 (C) to the tank line 16 (T), as shown in FIG. 2*d*. For this purpose, only a movement of the valve slide member 17 is necessary over a distance which corresponds to the sum of the thickness of the control disk 26 and the axial extension of the width of the end of the cylinder line 24 (C). This distance may be relatively small.

As can be seen in FIGS. 2*a* to 2*d*, the valve slide member 17 has a greater cross-sectional surface 27 at the end which faces the end of the control line 19 (HP) than at its opposite end face 29 which is in connection with the pressure space 21. Accordingly, the valve slide member 17 has a stepped configuration. Consequently, the pressure space 21 also has a smaller cross-section than the end face 27 of the valve slide member 17 which is acted upon by the pressure HP from the control line 19.

Finally, the valve slide member 17 includes a stop 28 which ensures that the pressure space 21 always has a predetermined minimum size. This minimum size is dimensioned in such a way that the schematically illustrated end of the connecting line 20 is always kept open. For structural reasons, this connecting line 20 cannot be connected to the end face of the housing 18. However, it is ensured in this manner that no throttling and, thus, no pressure reduction occurs. Accordingly, a constant force always acts on the valve slide member 17 independently of the position thereof.

The operation of the control valve 14 will now be explained with the aid of FIGS. 2*a* to 2*d* in connection with FIG. 1.

It shall be assumed that the intensifier piston 2 is in the position illustrated in FIG. 1. The high pressure piston 4 releases the end of the control line 19. The hydraulic liquid which flows from the pressure source P through the check valve 13 and the supply connection 12 into the high pressure cylinder 7 and fills the high pressure cylinder 7 produces on the end face 27 of the valve slide member 17 a corresponding pressure, i.e., the pressure of the pressure source P. The same pressure acts through the connecting line also on the opposite end face 29 of the valve slide member 17. However, since the end face 29 is smaller than the end face 27, the valve slide member 17 is acted upon by a force difference which acts from the top toward the bottom as seen in FIG. 2. Accordingly, the valve slide member 17 is displaced in such a way that the annular space 25 provides a connection between the pump line P and the cylinder line C.

This causes hydraulic liquid to flow from the pressure source P through the pump line 15, the control valve 14 and the cylinder line 24 to the low pressure connection 8. The low pressure cylinder 3 is acted upon by the pressure of the pressure source and moves the high pressure piston 4 upwardly in the direction toward the high pressure connection 9.

After a predetermined travel distance which corresponds to the length of the high pressure cylinder 4, the control line 19 is in connection with the tank line 23 so that only the tank pressure acts on the end face 27. However, since the opposite end face 29 is still acted upon by the pressure of the pressure source P, the valve slide member 17 is now moved upwardly. The valve slide member 17 initially interrupts the connection between the pump connection P and the cylinder connection C, shown in FIG. 2*b*, and then effects a connection through the annular space 25 (i. e., a different portion of the annular space 25) between the cylinder connection C and the tank connection T. The valve slide member 17 moves until it contacts the top of the housing 18. All directional indications provided above refer to the illustration in FIG. 2. In the position shown in FIG. 2*d*, the cylinder connection C is not longer covered by the control disk. In addition, the annular space 25 between the cylinder connection C and the tank connection T is enlarged because of the smaller diameter of the valve slide member 17 in this area. Consequently, a relatively large cross-section is available for the flow of the hydraulic liquid from the cylinder connection C to the tank connection T.

Since now a connection is effected between the low pressure connection 8 and the negative pressure source T, while the pressure of the pressure P acts on the high pressure piston 4 through the supply connection 12, the intensifier piston 2 now again moves toward the low pressure connection 8. Since, in this case, the force is produced only by the product between the pressure of the pressure source P and the cross-section of the high pressure piston 4, it is important that the resistance to the hydraulic liquid flowing off is as small as possible. This low resistance results from the complete release of the cylinder connection C in the control valve 14 and the larger portion of the annular space 25 in this position.

As soon as the intensifier piston 2 has reached its lower end position shown in FIG. 1, the pressure of the pressure source P again acts on the control line 19 and the valve slide member 17 is again pushed back into the position shown in FIG. 2*a*. The cycle begins anew.

Since a constant pressure acts on the end face 29 of the valve of the valve slide member, relatively high frequencies can be achieved which lead to a correspondingly rapid refilling of the high pressure cylinder 7 and the low pressure cylinder 6. This makes it possible to increase the quantity discharged by the fluid intensifier.

While specific embodiments of the invention have been shown and described in detail to illustrate the inventive principles, it will be understood that the invention may be embodied otherwise without departing from such principles.

What is claimed is:

1. A pressure intensifier for fluids comprising a piston/cylinder arrangement having a low pressure side with a low pressure connection and a high pressure side with a high pressure connection and a supply connection, further comprising an intensifier piston constructed as a double diameter piston between the low pressure side and the high pressure side, and a control valve including a valve slide member for alternatingly connecting the low pressure connection to a pressure source and a low pressure source, the valve slide member having a first side and a second side, a control line connecting the control valve to the piston/cylinder arrangement, such that pressure in the control line acts on the first side of the valve slide member, wherein the control valve is configured such that a constant force acts on the second side of the valve slide member, with said constant force being generated by said constant pressure in a pressure space and wherein there is no flow through the pressure space to the low pressure connection when said low pressure connection is connected to the pressure source, wherein the control valve further comprises a valve housing, an annular space being defined between the valve slide member and the valve housing, a tank line connected to the low pressure source and a pump line connected to the pressure source being in communication with the annular space, and a cylinder line connected to the low pressure connection being in communication with the annular space between the pump line and the tank line, the valve slide member further comprising a control disc dividing the annular space, wherein, depending on a position of the valve slide member, the control disc is located either between the pump line and the cylinder line or between the cylinder line and the tank line.

2. The pressure intensifier according to claim 1, wherein the control disk does not throttle a connection between the tank line and the cylinder line in a position in which a connection exits between the cylinder line and the tank line.

3. The pressure intensifier according to claim 1, wherein the control valve is configured such that pressure of the pressure source acts on the second side of the valve slide member.

4. A pressure intensifier for fluids comprising a piston/cylinder arrangement having a low pressure side with a low pressure connection and a high pressure side with a high pressure connection and a supply connection, further comprising an intensifier piston constructed as a double diameter piston between the low pressure side and the high pressure side, and a control valve including a valve slide member for alternatingly connecting the low pressure connection to a pressure source and a low pressure source, the valve slide member having a first side and a second side, a control line connecting the control valve to the piston/cylinder arrangement, such that pressure in the control line acts on the first side of the valve slide member, wherein the control valve is configured such that a constant force acts on the second side of the valve slide member, with said constant force being generated by a constant pressure in a pressure space and wherein there is no flow through the pressure space to the low pressure connection when said low pressure connection is connected to the pressure source, further comprising stop means for the valve slide member for keeping open a connection between the second side and the connection to the pressure source.

5. The pressure intensifier according to claim 4, wherein the control valve is configured such that pressure of the pressure source acts on the second side of the valve slide member.

* * * * *